US008033447B2

(12) United States Patent
Katoh

(10) Patent No.: US 8,033,447 B2
(45) Date of Patent: Oct. 11, 2011

(54) CONTAINER STORAGE BOX FOR DEFORMABLE CONTAINER CONTAINING FINE PARTICLES FOR IMAGE FORMATION

(75) Inventor: Keisuke Katoh, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 803 days.

(21) Appl. No.: 11/722,614

(22) PCT Filed: Dec. 21, 2005

(86) PCT No.: PCT/JP2005/024006

§ 371 (c)(1),
(2), (4) Date: Mar. 7, 2008

(87) PCT Pub. No.: WO2006/068296

PCT Pub. Date: Jun. 29, 2006

(65) Prior Publication Data

US 2008/0265009 A1 Oct. 30, 2008

(30) Foreign Application Priority Data

Dec. 22, 2004 (JP) ..... 2004-372179

(51) Int. Cl.
*B65D 5/355* (2006.01)
*B65D 5/56* (2006.01)

(52) U.S. Cl. ..... 229/101; 229/115; 229/117.27; 229/117.35; 229/138; 229/939; 229/940; 399/262

(58) Field of Classification Search ..... 229/115, 229/117, 117.27, 117.28, 117.3, 117.35, 229/138, 186, 101, 939, 940; 383/120
See application file for complete search history.

(56) References Cited

U.S. PATENT DOCUMENTS

| | | | | |
|---|---|---|---|---|
| 3,481,524 | A * | 12/1969 | Ruud et al. | 229/117.23 |
| 3,534,898 | A * | 10/1970 | Manizza | 229/117 |
| 3,955,749 | A * | 5/1976 | Turkenkopf | 383/120 |
| 4,243,171 | A * | 1/1981 | Prin | 229/117 |
| 4,523,615 | A | 6/1985 | Feenstra et al. | |
| 4,734,288 | A * | 3/1988 | Engstrom et al. | 229/115 |

(Continued)

FOREIGN PATENT DOCUMENTS

CN 2427445 Y 4/2001

(Continued)

*Primary Examiner* — Gary Elkins
(74) *Attorney, Agent, or Firm* — Oblon, Spivak, McClelland, Maier & Neustadt, L.L.P.

(57) ABSTRACT

A container storage box containing and storing a deformable container includes a plurality of rigid sidewall faces that contain and store the deformable container while preventing random deformation of the deformable container and large and small end faces of both top and bottom ends of the plurality of rigid sidewall faces. The rigid sidewall faces regulate a configuration of the deformable container in a configuration accommodated in the container loading part while maintaining at least one of direction and/or position of content outlet of the deformable container when the deformable container is placed in the image forming apparatus. At least one of the sidewall faces includes at least two fold lines not parallel with one another and at least one end face of both top and bottom end faces except the plurality of sidewall faces has a closing mechanism that is openable, closable and capable of being assembled and disassembled.

19 Claims, 5 Drawing Sheets

U.S. PATENT DOCUMENTS

| | | | | |
|---|---|---|---|---|
| 5,042,714 | A * | 8/1991 | Hall | 229/117 |
| 5,083,700 | A * | 1/1992 | Mello et al. | 229/115 |
| 6,253,995 | B1 * | 7/2001 | Blok et al. | 229/939 |
| 6,478,216 | B2 * | 11/2002 | Wiart | 229/101 |
| 2006/0002743 | A1 | 1/2006 | Katsuyama et al. | |
| 2006/0144746 | A1 * | 7/2006 | Katsuyama | 206/525 |
| 2006/0191984 | A1 * | 8/2006 | Hitosugi | 229/112 |
| 2007/0140747 | A1 | 6/2007 | Kita et al. | |
| 2007/0241900 | A1 * | 10/2007 | Sasazaki | 340/572.1 |

FOREIGN PATENT DOCUMENTS

| | | |
|---|---|---|
| JP | 60 35765 | 2/1985 |
| JP | 62 31021 | 2/1987 |
| JP | 6 183435 | 7/1994 |
| JP | 3015672 | 6/1995 |
| JP | 7 40427 | 7/1995 |
| JP | 2005 206242 | 8/2005 |
| WO | WO 03/082685 A1 | 10/2003 |

* cited by examiner

CONTAINER STORAGE BOX FOR DEFORMABLE CONTAINER CONTAINING FINE PARTICLES FOR IMAGE FORMATION

TECHNICAL FIELD

The present invention relates to a container storage box for packing a deformable container containing fine particles for image formation as its contents which is easily deformed.

BACKGROUND ART

Conventionally, majority of containers used for containing fine particles for image formation (toner and developer) have been blow molding bottles and non-flexible rigid cartridges produced by injection molding. They are hard to deform and setting of the container to the main part of the image forming apparatus is easily performed. However, they are very bulky when collected and transported for recycle and are not satisfactory in terms of handling.

On the other hand, in recent years, a flexible toner container which is foldable has been proposed and used. However, the toner container is made out of soft packing material composed of polyethylene terephthalate (PET), oriented nylon (ON) and linear low-density polyethylene (LLDPE); setting to the apparatus directly is difficult because of deformation during transportation and coagulation of content in the container with a deformed state. And improper setting to the apparatus may also occur by a bended head portion of the container. The toner discharge capability and toner volume reduction capability of these easily deformed containers are deteriorated by deformation of the container. When cushioning material is used for packing material to overcome this problem, the quantity of packing material being discarded and packing cost increases or the transportation and storage efficiencies are deteriorated because of the increase in container size. In addition, the volume of the container increases (expands) to deform the container storage box under depressurized condition such as an elevation of 2,500 m, for example, because of sealed state of the container.

When an easily deformed container is used as a cartridge, the setting to the apparatus directly is difficult because of deformation during transportation and coagulation of contents in the container with a deformed state. And improper setting may occur because of a bended head portion of the container. In addition, the volume reduction of the container becomes difficult during toner discharge, toner discharge capability is not stabilized, the volume reduction of the container itself becomes incomplete and the handling at the time of resetting becomes difficult. When cushioning material is used for packing material to overcome this problem, the quantity of packing material being discarded and packing cost increases or the transportation and storage efficiencies are deteriorated because of the increase in size of the container storage box. Moreover, storage in transverse direction may be recommended in order to prevent coagulation of fine particles, which are the contents of the container, caused by the weight of fine particles.

Therefore, the packing method and the packing material, with which transportation of the deformable container without deforming the container is possible; the deformable container is easily taken out from the packed condition; a cushioning effect when falling is provided; the container is hardly deformed so that the setting to the main part of the apparatus is not affected even when the content is coagulated; and the above problems can be settled, had been desired.

In addition, it is also required to be able to keep the easily deformed flexible container with no difficulty when the content of the flexible container expanded at the time of being contained, transported and stored; to easily take out the flexible container filled with the content; to contain, collect and reuse the flexible container in the volume reduced state after usage.

On the other hand, a corrugated cardboard box with a partition attached which can pack and protect the contained goods and reduce the chance of deformation of contained goods has been proposed in Patent Literature 1. With this kind of corrugated cardboard box with the partition which can contain two pieces of contained goods, however, when the unit of the contained goods is one piece, one of them has to be taken out from the corrugated cardboard box and sold without being contained in the corrugated cardboard box. If the contained product is not used immediately after the purchase, the form of the container collapses and when the content coagulate in the deformed container, setting of the product to the main part of apparatus becomes difficult. In addition, cushioning material increases in amount and packing cost increases, or the quantity of packing material being discarded also increases and transportation efficiency is deteriorated because of the increase in size of the container storage box itself. Furthermore, it is likely that the corrugated cardboard box takes the shape of a cuboid and has a poor design characteristic.

A container storage box which contains and stores a deformable container having a flexible region at least in part and is capable of discharging fluid content for image formation when placed in a container loading part of an image forming apparatus is proposed in Patent Literature 2. The container storage box has a rigid sidewall face at least in part which contains and store the deformable container while preventing random deformation of the deformable container. The rigid sidewall face regulates a configuration of the deformable container in a configuration accommodated in the container loading part while keeping one of direction and/or position of content outlet of the deformable container when the deformable container is placed in the image forming apparatus. The container storage box is made out of a plate material foldable in the form of box and has a square-shaped part composed of a number of sidewall faces having fold lines for retaining strength in the assembled state.

In this proposal, however, the container storage box does not have two fold lines which are not parallel to one another and there is no disclosure or suggestion regarding the closing mechanism which is composed of a pair of bed-type framing pieces of at least one of the end faces of small and large dimension and openable, closeable and capable of being assembled and disassembled by hand pressing.

[Patent Literature 1] Japanese Utility Model Application (JP-Y) No. 3039149

[Patent Literature 2] Japanese Patent Application Laid-Open (JP-A) No. 2005-206242

DISCLOSURE OF INVENTION

It is an object of the present invention to provide a container storage box with which the deformation of a container during transportation and storage or the deformation of the container accompanying the coagulation of the contents are suppressed, the setting of the container to the main part of the image forming apparatus is not affected and the container is protected and fixed without the use of the cushioning material.

The measures to solve above-mentioned problems are as follow.

<1> A container storage box having a plurality of rigid sidewall faces which contains and stores a deformable container while preventing random deformation of the deformable container and large and small end faces of both top and bottom of the plurality of rigid sidewall faces wherein the deformable container having a flexible region at least in part and is capable of discharging fluid content for image formation when placed in a container loading part of an image forming apparatus is contained; the rigid sidewall face regulates a configuration of the deformable container in a configuration accommodated in the container loading part while maintaining at least one of direction and position of the content outlet of the deformable container when the deformable container is placed in the image forming apparatus; at least one of rigid sidewall faces contains at least two fold lines which are not parallel with one another; and at least one end face of top and bottom end faces except the plurality of rigid sidewall faces has a closing mechanism which is openable, closable and capable of being assembled and disassembled.

<2> The container storage box defined in above <1>, wherein the fold line is disposed in an angle in the sidewall faces enabling to fold the rigid sidewall faces deeper in a direction the inner volume of the container storage box reduces toward one of top and bottom end faces.

The container storage box defined in one of above <1> and <2> has advantageous effects such as preventing the deformation of the container which makes setting of the container to the main body of an apparatus difficult, absorbing the volume difference between an elevation of 2,500 m (depressurized condition) and an elevation of 0 m, securing the strength of the container storage box, fixing the deformable container, and enabling the folding part to be easily folded after the container is inserted into the container storage box.

<3> The container storage box defined in one of above <1> and <2>, wherein the fold of the rigid sidewall face is in the form of the container storage box having two fold lines stretched from the center of upper part to the both corners of lower part. The container storage box defined in above <3> is in the form of squire pyramid and exhibits appropriate transport efficiency (takes less space with a combination of 2 pieces/set).

<4> The container storage box defined in one of above <1> to <3>, wherein an end part of at least one of the rigid sidewall faces has an extension. The container storage box defined in above <4> has a function of antislip when piled up and a finger-catch when a vertically positioned box is grabbed by hand.

<5> The container storage box defined in one of above <1> to <4>, wherein the dimension $S_A$ of the end face disposed on the side having the closing mechanism and the dimension $S_B$ of the end face disposed on the side not having the closing mechanism of the top and bottom end faces except the plurality of rigid sidewall faces satisfies the next equation, $S_A<S_B$. The container storage box defined in above <5> can protect the container without the use of cushioning material; reduce the number of components of packing material; and realize the cost reduction.

<6> The container storage box defined in above <5>, wherein the opposing end faces make up a bottom part, the bottom part has the closing mechanism and the closing mechanism contains a combination of two bed-type end-face framing pieces which are mutually symmetric, wherein each bed-type end-face framing piece contains a diagonal fold line of head region, insertion tongue-shaped piece and receiving concave part of the side, and wherein the bottom part is engaged by one-touch operation of inserting the tongue-shaped piece into the opposing concave part and disengaged by one-touch operation of pressing the portion of diagonal fold line of head region toward the inside of the container storage box. The container storage box defined in above <6> can be delivered folded and has an appropriate workability.

<7> The container storage box defined in one of above <1> to <6>, wherein both top and bottom end faces have a closing mechanism. Since the container storage box defined in above <7> requires no gluing, cost reduction of the container storage box is possible. And because it does not choose direction of removal when the container is removed from the container storage box, handling is relatively easy.

<8> The container storage box defined in one of above <1> to <7>, wherein two or more sidewall faces of the plural rigid sidewall faces are inclined so as to diminish toward the end face of the side having the closing mechanism. The container storage box defined in above <8> has advantageous effects of preventing deformation and bended head portion of the container when falling or keeping (protecting) the form of the container during storage.

<9> The container storage box defined in one of above <1> and <2>, wherein the fold of the rigid sidewall face has a form of the container storage box having a mechanism of branching from the center of upper part of the sidewall face and folding in from both sides in the region short of the lower part of the sidewall face. The container storage box defined in above <9> has an advantageous effect of taking a form in accordance with the volume of the container.

<10> The container storage box defined in above <9>, wherein the dimension $S_C$ of the end face disposed on the side having the closing mechanism and the dimension $S_D$ of the end face disposed on the side not having the closing mechanism of the top and bottom end faces except the plurality rigid sidewall faces satisfies the next equation, $S_C<S_D$. The container storage box defined in above <10> can protect the container without the use of cushioning material; reduce the number of components of packing material; and realize the cost reduction.

<11> The container storage box defined in above <10>, wherein the opposing end faces make up a bottom part, the bottom part contains a combination of two bed-type end-face framing pieces which are mutually symmetric, wherein each bed-type end-face framing piece contains diagonal fold line of head region, insertion tongue-shaped piece and receiving concave part of the side, and wherein the bottom part is engaged by one-touch operation of inserting the tongue-shaped piece into the opposing concave part and disengaged by one-touch operation of pressing the portion of diagonal fold line of head region toward the inside of the container storage box. The container storage box defined in above <11> can be delivered folded and has an appropriate workability.

<12> The container storage box defined in one of above <9> to <11>, wherein both top and bottom end faces have a closing mechanism. Since the container storage box defined in above <12> requires no gluing, cost reduction of the container storage box is possible. And because it does not choose direction of removal when the container is removed from the container storage box, handling is relatively easy.

<13> The container storage box defined in one of above <9> to <12>, wherein two or more sidewall faces of the plural rigid sidewall faces are inclined so as to diminish toward the end face of the side having the closing mechanism. The container storage box defined in above <13> has advantageous effects of preventing deformation and bended head portion of the container when falling or keeping (protecting) the form of the container during storage.

<14> The container storage box defined in one of above <1> to <13>, wherein the rigid sidewall face is a cardboard with the flutes running in lateral direction. The container storage box as defined in above <14> has effect of improving the strength of the container storage box and allows the side to be effectively folded by having the sidewall face of the cardboard with the flutes running in lateral direction.

<15> The container storage box defined in one of above <1> to <13>, wherein the material of the rigid sidewall face is a G flute.

<16> The container storage box defined in one of above <1> to <15>, wherein the container storage box is stored vertically with the end face of large dimension down. The container storage box as defined in above <16> can improve the refilling ability by storing the container storage box vertically with the end face of large dimension down and reversing it at the time of usage.

<17> The container storage box defined in one of above <1> to <16>, wherein the container storage box is useable as a collecting box of used toner cartridge.

<18> The container storage box defined in one of above <1> to <17>, wherein the container storage box is fixed by being wrapped with a belt-like film around the periphery side of the container storage box.

<19> The container storage box defined in above <18>, wherein the belt-like film is a printed display label.

<20> The container storage box defined in one of above <1> to <19>, wherein the fluid content for image formation is at least one of toner and developer.

BEST MODE FOR CARRYING OUT THE INVENTION

The container storage box of the present invention contains and stores a deformable container having a flexible region at least in part and is capable of discharging fluid content for image formation when placed in a container loading part of an image forming apparatus.

The container storage box has a plurality of rigid sidewall faces which contain and store the deformable container while preventing random deformation of the deformable container and end faces of small and large dimension on top and bottom of the plurality of rigid sidewall faces and further has other composition as necessary.

The rigid sidewall face regulate a configuration of the deformable container in a configuration accommodated in the container loading part while maintaining at least one of direction and position of the content outlet of the deformable container when the deformable container is placed in the image forming apparatus.

And at least one of the rigid sidewall faces contains at least two fold lines which are not parallel with one another and one of the top and bottom end faces except the plurality of rigid sidewall faces has a closing mechanism which is openable, closable and capable of being assembled and disassembled.

The fold line is preferably placed in the sidewall faces in an angle enabling to fold the rigid sidewall faces deeper into the direction the inner volume of the container storage box narrows toward one of the top and bottom end faces.

The material of the container storage box is not particularly limited and may be selected accordingly. Examples include general plate materials such as paperboard, etc., cardboard materials, and the like and of these, a cardboard material of E flute/K6 is particularly preferable.

G flute is preferable in terms of the quality of material for the rigid sidewall face.

Examples of the fluid content for image formation include toner, developer, and the like.

Hereinbelow, an example of the container storage box of the present invention will be described in detail referring to drawings.

The First Embodiment

Figure 1A:
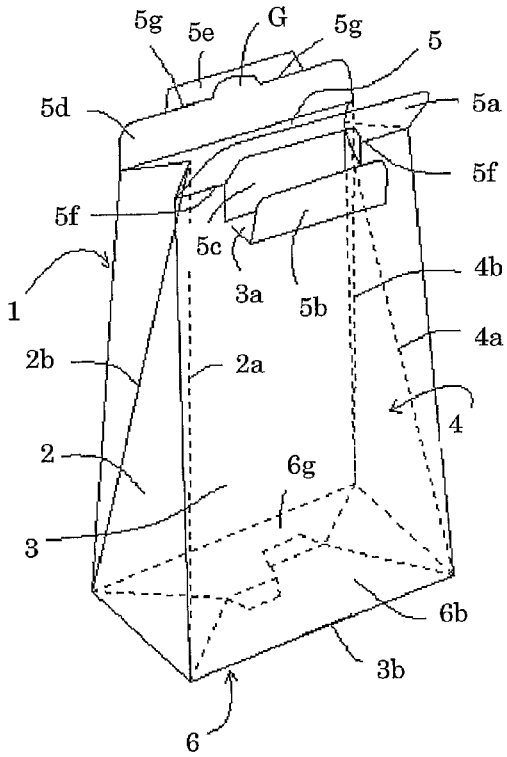
FIG. 1A is a perspective view showing an exemplary container storage box according to the first embodiment of the present invention.

FIG. 1 is an assembly drawing showing an exemplary container storage box according to the first embodiment of the present invention. The container storage box of FIG. 1 is used to contain, transport and store a deformable container having a flexible region at least in part and is capable of discharging fluid content for image formation when placed in a container loading part of an image forming apparatus. The deformable container (not shown) contains fluid content for image formation such as toner, developer, and the like and has an outlet for discharge.

The container storage box of FIG. 1 is an exemplary hexahedron having a rigid sidewall face 1 which is in the back of FIG. 1, a rigid sidewall face 2 which is in left hand side of FIG. 1, a rigid sidewall face 3 which is in the front of FIG. 1, a rigid sidewall face 4 which is in right hand side of FIG. 1, and an end face 5 and an end face 6 which are on the top and bottom of the rigid sidewall faces. The end face 5 is an end face of small dimension and the end face 6 is an end face of large dimension. Moreover, two sidewall faces of the plurality of sidewall faces 1, 2, 3 and 4 are in an angle narrowing toward the end face 5 of small dimension on closing side.

Figure 1B:
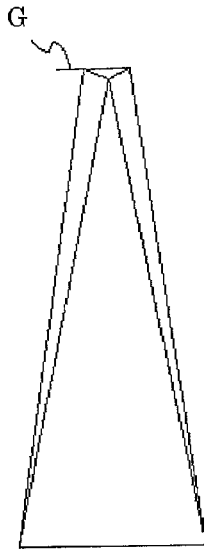
FIG. 1B is a side view of the container storage box of FIG. 1A.

In addition, as shown in FIG. 1B, it is preferable for the container storage box to have an extension piece G at the end part of at least one of the top and bottom end faces, that is, the end part of the end face 5 of small dimension in FIG. 1B, because it can function as an antislip when piled up and as a finger-catch when a vertically positioned box is grabbed by hand.

The rigid sidewall faces 1, 2, 3 and 4 regulate the configuration of the deformable container in a configuration accommodated in the container loading part while maintaining at least one of direction and position of the content outlet of the deformable container when the deformable container is placed in the image forming apparatus.

The rigid sidewall face 2 has two fold lines 2*a* and 2*b* and the fold lines 2*a* and 2*b* are placed in the sidewall face 2 in an angle enabling to fold the rigid sidewall faces deeper into the direction the inner volume of the container storage box narrows toward the end face 5 of small dimension of the end faces 5 and 6. Furthermore, though it is not mandatory in the present invention, the sidewall face 4 which faces the sidewall face 2 also has two fold lines 4*a* and 4*b* as in the exemplary container storage box. In this example, the folded sidewall faces are composed of two fold lines 2*a*, 2*b*, 4*a* and 4*b* which are stretched from the center of upper part toward both corners of the lower part.

The container storage box of this example has a closing mechanism which is openable and closable on the end face 5 of small dimension of the top and bottom end faces 5 and 6. In this closing mechanism, the end face 5 of small dimension is closed by folding the folding part 5*a* placed at the tip of the sidewall face 3 in a direction from front to back of FIG. 1, folding the folding part 5*d* placed at the tip of the sidewall face 1 in a direction toward front of FIG. 1 and lapping it over the folding part 5*a*, and after inserting the insertion tongue-shaped piece 5*e* placed at the tip of the folding part 5*d* into the slit-like cutout 5*f*, inserting the insertion tongue-shaped piece 5*b* at the tip of the folding part 3*a* into the slit-like cutout 5*g* placed between the folding part 5*d* and the insertion tongue-shaped piece 5*e*.

And it can be opened by pulling out the insertion tongue-shaped piece 5*b* from the slit-like cutout 5*g* and raise the folding part 3*a*, and after pulling out the insertion tongue-shaped piece 5*e* from the slit-like cutout 5*f* and raise the folding part 5*d*, raising the folding part 5*a* as opposite of closing. The folding part 5*a* has an opening 5*c* as a result of forming folding part 3*a* and the insertion tongue-shaped piece 5*b*.

In consequence, the end face 5 of small dimension is formed by placing the folding parts 5*a* and 5*d* on top of the other. (Furthermore, a portion of the end face 5 of small dimension is a threefold with the insertion tongue-shaped piece 5*b* placed on top.) The folding part 5*a* is firmly locked by the engagement of insertion tongue-shaped piece 5*e* placed at the tip of the folding part 5*d* and slit-like cutout 5*f* and also by the engagement of insertion tongue-shaped piece 5*b* and slid edge 5*g* and still can be unlocked easily to open the end face 5 of small dimension. In this example, the relation between dimension $S_A$ of the end face on the closing side and dimension $S_B$ of the end face on non-closing side (opposing end face) is $S_A<S_B$.

The closing mechanism of the present invention is not necessary be elaborate like this, and folding part 5*a* or insertion tongue-shaped piece 5*b* which engages with the slit-like cutout 5*g* or insertion tongue-shaped piece 5*e* which engages with the slit-like cutout 5*f* may be omitted.

Figure 2:
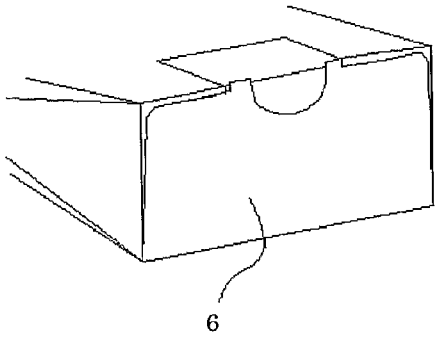
FIG. 2 is a view describing an exemplary closing mechanism of the container storage box of the present invention.

As shown in FIG. 2, this kind of closing mechanism can be disposed on the end face 6 of large dimension as well as on the end face 5 of small dimension. Or, the closing mechanism can be disposed on the end face 6 instead of on the end face 5.

Second Embodiment

Figure 3A:
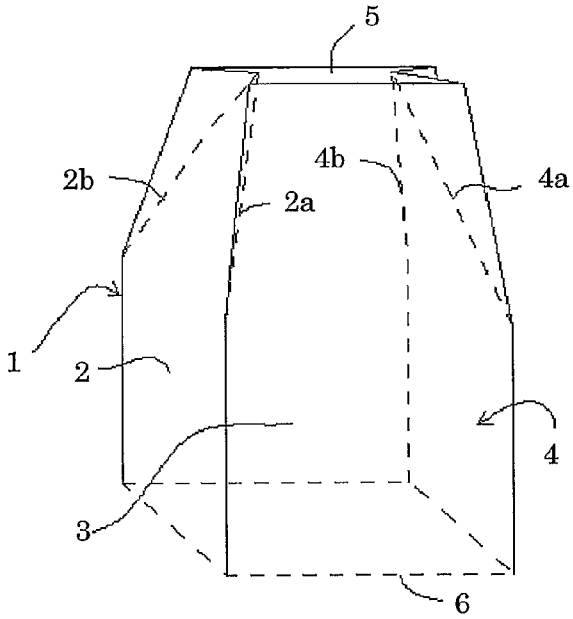
FIG. 3A is a perspective view showing another exemplary container storage box according to the second embodiment of the present invention.

FIG. 3A is an assembly drawing showing an exemplary container storage box according to the second embodiment of the present invention.

The container storage box of this example is also a hexahedron having 4 rigid sidewall faces 1, 2, 3 and 4 which include a rigid sidewall face 1 which is in the back of FIG. 3A, a rigid sidewall face 2 which is in left hand side of FIG. 3A, a rigid sidewall face 3 which is in the front of FIG. 3A and a rigid sidewall face 4 which is in right hand side of FIG. 3A, and an end face 5 of small dimension and an end face 6 of large dimension which are placed at the top and bottom of the rigid sidewall faces. However, openable and closable closing mechanism is not shown in FIG. 3A.

In this example, the relation between dimension $S_C$ of the end face placed in closing side and dimension $S_D$ of the end face placed in non-closing side (opposing end face) is $S_C<S_D$.

In the container storage box of this example, fold lines 2*a*, 2*b*, 4*a* and 4*b* are branched from the center of upper part of the sidewall faces 2 and 4 and stretched to the extent not reaching the lower part of the sidewall face of the container storage box. Therefore, the form of the container storage box has a mechanism of folding in both sides of the sidewall faces 2 and 4 in a portion short of the lower part.

In this example, fold lines 2*a*, 2*b*, 4*a* and 4*b* described here are extreme ones which are branched from the center of upper part of the sidewall faces 2 and 4, however, it is possible to make appropriate gaps between end parts of fold lines 2*a*, 2*b*, 4*a* and 4*b* in the upper part of the sidewall faces 2 and 4 or it is also possible to have no gaps depending on the size of an outlet of fluid content of the deformable container contained in the container storage box, cap size or the height of the deformable container. The container storage boxes of these aspects are included as preferred examples of the container storage box.

Figure 3B:
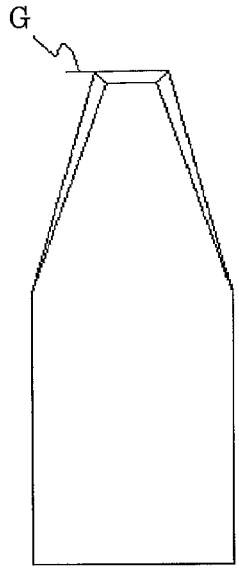
FIG. 3B is a side view of the container storage box of FIG. 3A.

In addition, as shown in FIG. 3B, it is preferable for the container storage box to have a extension piece G at the end part of at least one of the top and bottom end faces, that is, the end part of the end face 5 of small dimension in FIG. 3B, because it can function as an antislip when piled up and also as a finger-catch when a vertically positioned box is grabbed by hand.

Figure 4A:
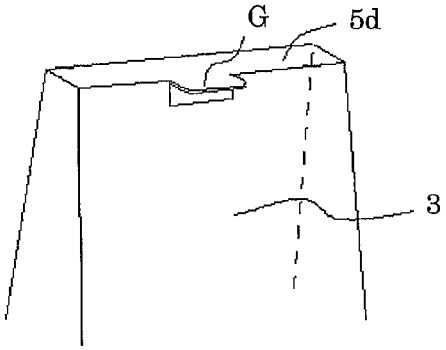
FIG. 4A is a view describing an example of stacked container storage boxes of the present invention.
Figure 4B:
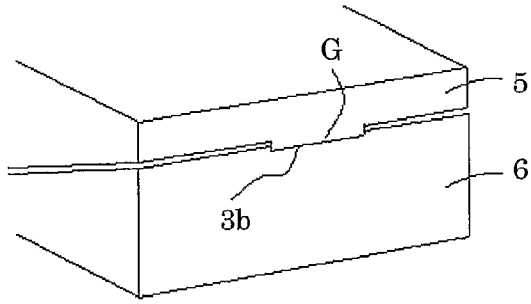
FIG. 4B is a view describing the container storage box of FIG. 4A when viewed from different angle.

And as shown in FIGS. 4A and 4B, the extension piece G which remains unfolded when fold lines are folded is disposed on the folding part 5*d* of the end face 5 of small dimension to have an extending portion after the box is assembled. An engagement slit 3*b* is disposed on the folding part of the sidewall face 3 for the engagement with the extension piece G.

Moreover, as shown in FIG. 4B, slip drop of upper container storage box can be prevented when the container storage box of the present invention is piled up by the engagement of the extension piece G and the engagement slit 3*b*. Also slip drop of upper container storage box can be similarly prevented by stacking the boxes in a way that the extension piece G is hooked to the outside of the end face 6 of large dimension while omitting the disposal of the engagement slit 3*b* (not shown).

In the container storage box as shown in FIG. 3A, one of the sidewall faces 1 and 3 and the end faces 5 and 6 are perpendicular to each other while other sidewall face takes the form of an acute angle so that the piled container storage boxes are in the form of cuboids. However this is not mandatory for this invention.

Figure 5:
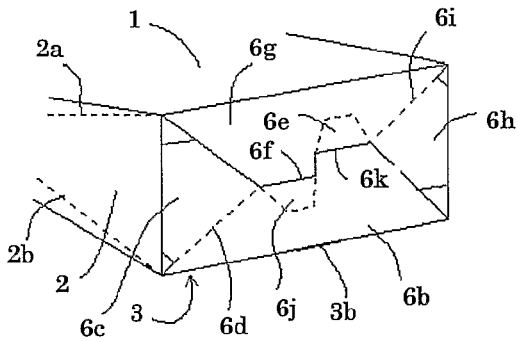
FIG. 5 is a view describing an exemplary end face of large dimension of the container storage box of the present invention.

As shown in FIG. 5, it is also possible to form an end face 6 of large dimension with a combination of two symmetric bed-type end-face framing pieces 6*b* and 6*g* and the end face 6 of large dimension, an opposing end face, to be a bottom part in this invention.

The bed-type sidewall framing piece 6*b* contains a diagonal fold line 6*d* of a head region 6*c*, an insertion tongue-shaped piece 6*e* of the side and adjacent receiving concave part 6*f*. The bed-type sidewall framing piece 6*g* contains a diagonal fold line 6*i* of head region 6*h*, an insertion tongue-shaped piece 6*j* of the side and adjacent receiving concave part 6*k*. The end-face framing pieces 6*b* and 6*g* are engaged by one-touch operation by inserting each insertion tongue-shaped piece 6*e* and 6*j* into the opposing receiving concave parts 6*k* and 6*f*. It can be disengaged by one-touch operation by pressing the portion of diagonal fold lines 6*d* and 6*i* of the head part toward the inside of the container storage box.

The strength of the end-face framing piece 6*b* can be appropriately improved by bonding the rigid sidewall material placed at the tip of the sidewall face 3 as an extension and the rigid sidewall material placed at the tip of the sidewall face 2 as an extension. In addition, strength of the end-face framing piece 6*g* can also be appropriately improved by bonding the rigid sidewall material placed at the tip of the sidewall face 1 as an extension and the rigid sidewall material placed at the tip of the sidewall face 4 as an extension. As a result, the end face 6 of large dimension is strengthened enough to hold the mass of contained contents.

Figure 6:
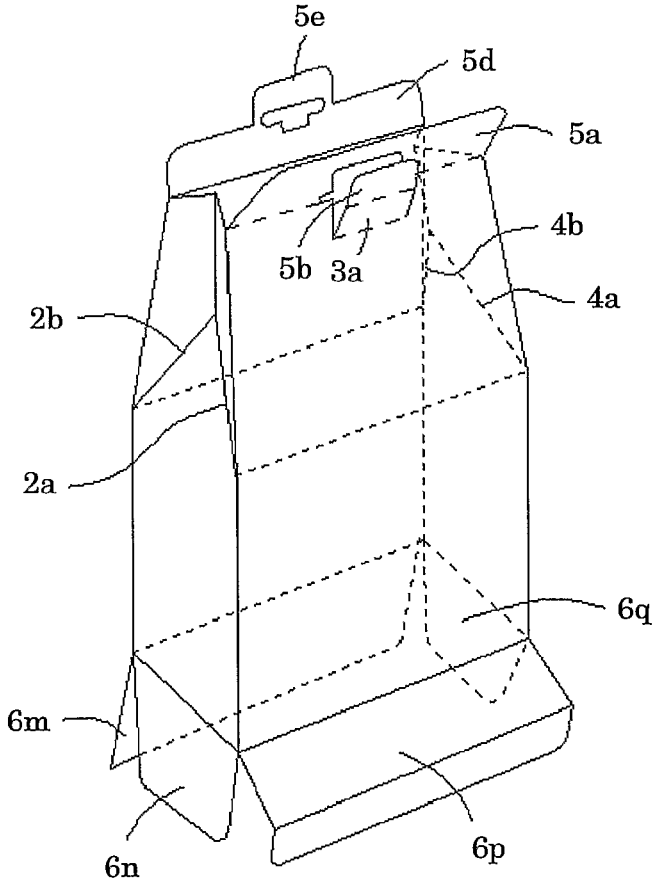
FIG. 6 is a perspective view showing another exemplary container storage box of the present invention.

The end face 6 of large dimension of the container storage box of the present invention is not particularly limited and may be selected accordingly. It may be composed of 4 end-face framing pieces 6*m*, 6*n*, 6*p* and 6*q* as shown in FIG. 6, for example.

Third Embodiment

Figure 7:
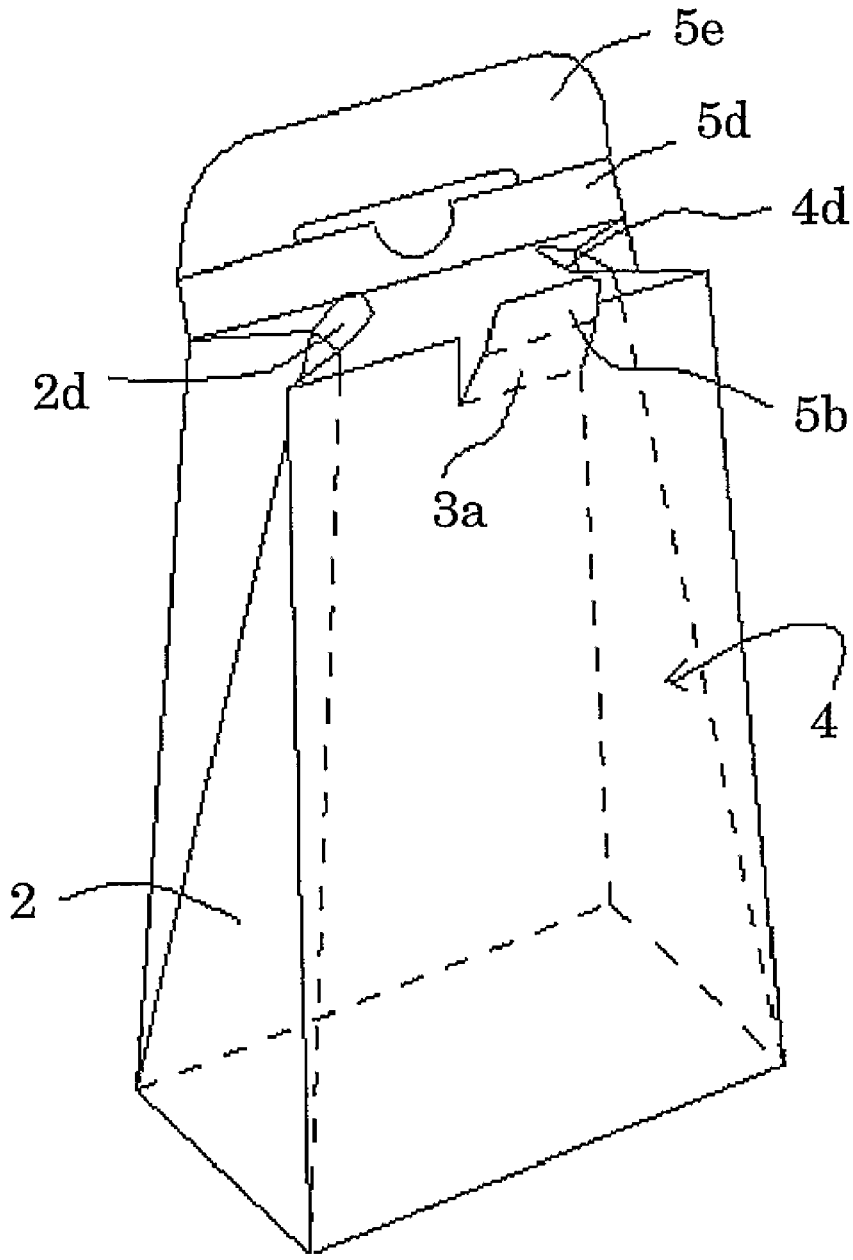
FIG. 7 is a perspective view showing an exemplary container storage box according to the third embodiment of the present invention.

The container storage box according to the third embodiment of the present invention is shown in FIG. 7. In the container storage box of this example, tongue-shaped piece 2*d* is placed at the end part of narrower side of the sidewall face 2 and tongue-shaped piece 4*d* is placed at the end part of narrower side of the sidewall face 4 instead of having the folding part 5*a* as in the examples shown in FIGS. 1A and 1B. The insertion tongue-shaped piece 5*e* placed at the tip of the folding part 5*d* as one element forming the end face 5 of small dimension can be satisfactory larger than that of the first embodiment shown in FIGS. 1A and 1B.

The third embodiment is similar to the first embodiment except for above points and the explanation is omitted.

A cardboard of E flute/K6 was used for the material of the container storage box according to these embodiments of the present invention. The material is not limited to above and it may be a cardboard material in general.

A toner cartridge was assigned as a deformable container and the size of bottom surface of these exemplary container storage boxes was set to 85 mm×120 mm which is the size fitted to be placed in the main body of an apparatus for the purpose of regulating it to not to expand to the size impossible to be placed in the main body of the image forming apparatus by deformation. Meanwhile, the size of bottom surface of the container storage box is not limited to above because interior content changes depending on the main body of the image forming apparatus and toner color.

<Deformable Container>

With referring to FIGS. 8A and 8B, an exemplary deformable container which is suitable to be contained in the container storage box of the present invention, having a flexible region at least in part and capable of discharging fluid content for image formation when placed in a container loading part of an image forming apparatus will be explained.

Figure 8A:
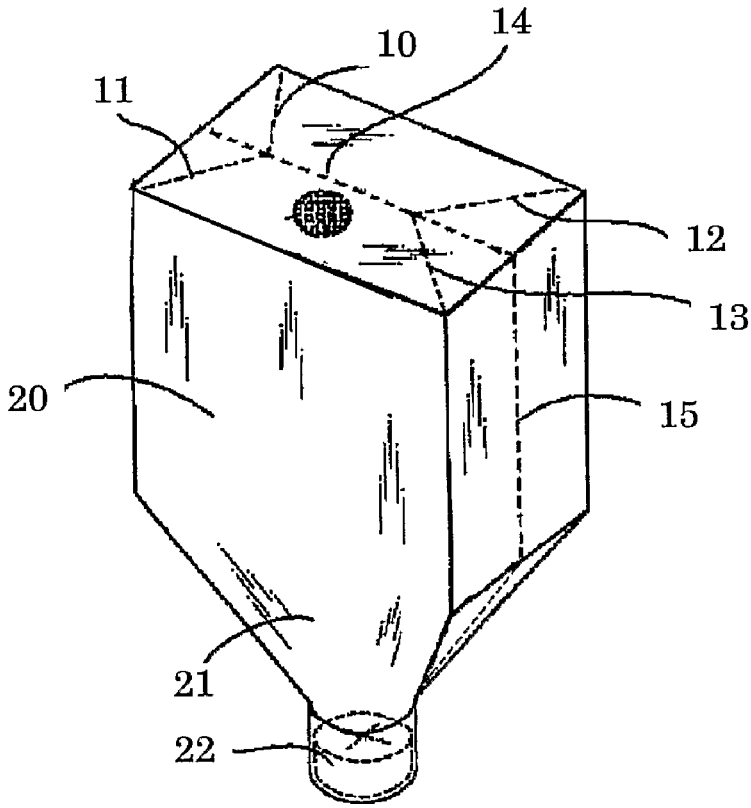
FIG. 8A is a view describing an exemplary deformable container suitable to be contained in the container storage box of the present invention.

The deformable container as shown in FIG. 8A is a soft type and composed of a bag part 20 which expands in the form of cuboids and a square-pyramid part 21 which is connected to the bag part 20 and a content outlet 22 placed in the most narrow part.

In the case of this soft type deformable container, it is advantageous in terms of manufacturing if the bag part and outlet are manufactured separately and are fixed together afterward.

The flexible material composing bag part include plastic sheets such as polyester, polyethylene, polyurethane, polypropylene and nylon resin, etc. or paper, and the like processed as a single layer or a multilayer of different materials and also include resin-coated paper, for example.

When two of the layer is made of resin, it is preferably tear resistant against the external pressure and the inside is preferably made of relatively soft materials such as intermediate/high pressure polyethylene and outside is preferably made of relatively hard materials such as nylon resin. Furthermore, the flexible material may be vapor deposited with aluminum or may be loaded with an antistatic agent to prevent static.

The thickness of flexible material is not particularly limited and it is preferably 20 μm to 200 μm and more preferably 80 μm to 150 μm. When it is too thick, advantageous effect of being flexible material cannot be obtained and when it is too thin, the part filled with toner sags and discharge of toner may not be performed satisfactory.

When the soft type container of the present invention is a toner container, it also includes the toner container with bag part and outlet which are independent and capable of connecting and separating.

The volume average particle diameter of toner particle is preferably 2.5 μm to 15 μm, more preferably 3.0 μm to 12.0 μm and most preferably 5.0 μm to 9.0 μm. The absolute specific gravity of toner is preferably 1.02 to 1.45 and more preferably 1.1 to 1.3. The filling density of toner is preferably 0.20 g/cm$^3$ to 0.90 g/cm$^3$ and more preferably 0.35 g/cm$^3$ to 0.85 g/cm$^3$.

In this case, it is preferably disposing a structure which can secure the sealed condition when connected, a screw structure or a joint structure, for example, and at least opening part of the bag part is preferably composed of relatively thick flexible material for above purpose.

The bag part has an opening part which is to be fixed with an outlet part. Furthermore, a bag part with a seam which is formed by bonding the prepared plural material pieces which are flexible by heat sealing, etc. to form a predetermined shape of a container or when the flexible material is a plastic resin, a bag part with no seams which is formed into a predetermined shape of a container by integral mounding of tube extrusion is used. As described above, a bag part not entirely composed of flexible material but partly composed of rigid material is also included.

A tubular body which makes up an outlet is composed of plastic material such as polyethylene and polypropylene or metals and is relatively rigid, and it is preferable that the material is at least identical with or related to the material making up the bag part for obtaining appropriate fixation result.

The tubular body can be classified broadly into joint part with nozzles, etc. and fixation part fixed with an opening part of the bag part and inner diameter and structure can be altered corresponding to the purpose of each portion.

Figure 8B:
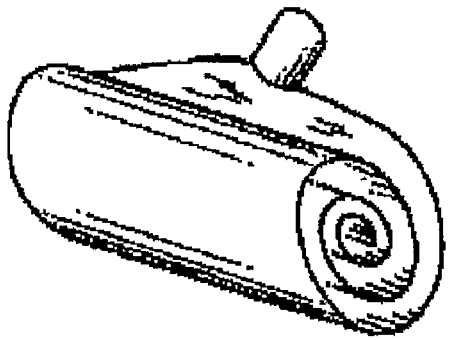
FIG. 8B is a view showing a folded condition of the deformable container of FIG. 8A.

The deformable container as shown in FIG. 8A can be folded thinly in the form of approximately flat plate at the bottom fold lines 10, 11, 12, 13 and 14 and side fold line 15 and can be rolled up slimly as shown in FIG. 8B.

The bottom portion does not form an approximately flat plate unless folded at the bottom fold lines 10, 11, 12, 13 and 14. On the other hand, since the square pyramid part 21 becomes thin in the form of approximately flat plate by only being folded at side fold line 15, it is likely to be bulky toward the bottom. In consequence, it is suitable for being contained in the container storage box of the present invention having above structure, however, if it is a container in the form of bag which is flexible, the present invention is not particularly limited to above structure.

The fold lines 2*a*, 2*b*, 4*a* and 4*b* on the side of the container storage box of the present invention are preferably placed from inside and outside of the container storage box. As a result, it is easily folded and assembled during manufacture of the container storage box.

When using a cardboard as a material for rigid sidewall face of the container storage box of the present invention, it is preferable to use the cardboard with the flutes running in lateral direction.

The strength of the container storage box increases by using a cardboard with the flutes running in lateral direction.

Furthermore, moldability is appropriate when the side face is being folded.

When the container storage box of the present invention is stored vertically with the end face of large dimension down, the refilling ability is improved. This is because the box is reversed at the time of use.

Moreover, the container storage box of the present invention can be used as a collecting box of used toner cartridge. It is also preferable to wrap a belt-like film around the periphery side of the container storage box of the present invention. By wrapping the belt-like film around the periphery side, it is possible to fix the container storage box or to fix the deformable container contained inside while suppressing the force of the deformable container to prevent it from opening itself. It becomes also tough against the fall. Furthermore, it is preferable that the film which fixes the container storage box of the present invention is printed. By using the film as a display label, printing on the container storage box can be eliminated and standardizing of the container storage box is possible.

In addition, it is preferable that the various slits for each flap insertion such as engagement slit 3*b* for the slit-like cutout G, the slit-like cutout 5*g* for the insertion tongue-like piece 5*b*, etc., for example, are cut off at a depth of 1 mm to 20 mm. By cutting the various slits at a depth of 1 mm to 20 mm, it is easy to insert a flap and workability is improved.

It is preferable to have a cutoff line of 1 mm to 5 mm length on the sidewall face of the container storage box of the present invention. By having a cutoff line of 1 mm to 5 mm on the sidewall face of the container storage box, it is easily folded and assembled at the time of manufacture.

In addition, it is preferable that the various slits for flap insertion such as engagement slit 3*b* for the slit-like cutout G, the slit-like cutout 5*g* for the insertion tongue-like piece 5*b*, the slit-like cutout 5*f* for the insertion tongue-like piece 5*e*, etc., for example, have an opening of 20 mm to 100 mm in width. By having various flap-joint slits for the container storage box with openings of 20 mm to 100 mm in width, it becomes easier to check a toner cartridge without taking the deformable container out from the container storage box and/or to adjust at each base.

The inner volume of the container storage box of the present invention is preferably 1.1 to 1.5 based on the volume of the deformable container which is 1. By having 1.1 to 1.5 inner volume of the container storage box of the present invention when the volume of the deformable container is 1, it is possible to retain the shape of the deformable container and to improve the strength of the container storage box.

In addition, the end form of each flap (insertion tongue-shaped piece) is preferably in a circular form and not in an angular form and is preferably 5 mm to 40 mm in radius. When the end form of flaps is 5 mm to 40 mm in radius, it becomes easier to assemble at the time of manufacture.

The container storage box of the present invention and the deformable container contained in the container storage box have been explained in detail above. However, the present invention is not limited to above embodiments and making various changes is allowed as long as it does not deviate from the summary of the present invention.

INDUSTRIAL APPLICABILITY

Because the container storage box of the present invention can suppress the deformation of a container during transportation and storage and the deformation associated with the solidification of contents; does not affect the setting of the container to the main body of an image forming apparatus; and can protect and fix the container without the use of cushioning material, it is suitably used for various image forming apparatuses.

The invention claimed is:

1. A storage system, comprising:

a deformable container, including:

a flexible region;

image developer within the deformable container; and an outlet, at a most narrow portion of the deformable container, which discharges the image developer when placed in a container loading part of an image forming apparatus, and a container storage box, including:

a plurality of rigid sidewall faces to contain and store the deformable container while preventing random deformation of the deformable container; and large and small end faces at a top and bottom of the box to connect the plurality of rigid sidewall faces, wherein the plurality of rigid sidewall faces regulates a configuration of the deformable container in a configuration accommodated in the container loading part while maintaining at least one of direction and position of the content outlet of the deformable container when the deformable container is placed in the image forming apparatus, wherein at least one of the rigid sidewall faces comprises at least two fold lines which are not parallel with one another, wherein at least one of the end faces comprises a closing mechanism which is openable, closable and capable of being assembled and disassembled, and wherein the outlet of the deformable container is next to the small end face at the bottom of the box.

2. The storage system according to claim 1, wherein the at least two fold lines are disposed at an angle in the at least one of the sidewall faces enabling to fold the rigid sidewall faces deeper in a direction towards an interior of the container storage box reduces toward one of the top and bottom end faces.

3. The storage system according to claim 1, wherein the at least two fold lines comprise two fold lines from a center of an upper part to both corners of a lower part.

4. The storage system according to claim 1, wherein an end part of at least one of the rigid sidewall faces comprises an extension.

5. The storage system according to claim 1, wherein a dimension $S_A$ of one of the top and bottom end face disposed on a side comprising the closing mechanism and a dimension $S_B$ of the other of the top and bottom end face disposed on a side not comprising the closing mechanism satisfies the equation, $S_A<S_B$.

6. The storage system according to claim 5, wherein the bottom face comprises opposing bottom end faces which form a bottom part, the bottom part comprises the closing mechanism and the closing mechanism comprises a combination of end-face framing pieces which are mutually symmetric, wherein each end-face framing piece comprises a diagonal fold line at a head region, an insertion tongue-shaped piece, and a receiving concave part, and wherein the bottom part is engaged by one-touch operation of inserting the tongue-shaped piece into the opposing concave part and disengaged by one-touch operation of pressing the portion of diagonal fold line of head region toward the inside of the container storage box.

7. The storage system according to claim 1, wherein both the top and bottom end faces comprise a closing mechanism.

8. The storage system according to claim 1, wherein two or more sidewall faces of the plurality of rigid sidewall faces are inclined so as to diminish toward the end face of the side comprising the closing mechanism.

9. The storage system according to claim 1, wherein the fold of the rigid sidewall face comprises a form of the container storage box having a mechanism of branching from the center of upper part of the sidewall face and folding in from both sides in the region short of the lower part of the sidewall face.

10. The storage system according to claim 9, wherein a dimension $S_C$ of one of the top and bottom end face disposed on the side comprising the closing mechanism and a dimension $S_D$ of the other of the top and bottom end face disposed on the side not comprising the closing mechanism satisfies the equation, $S_C<S_D$.

11. The storage system according to claim 10, wherein the bottom face comprises opposing bottom end faces which form a bottom part, the bottom part comprises a combination of end-face framing pieces which are mutually symmetric, wherein each end-face framing piece comprises diagonal fold line at a head region, an insertion tongue-shaped piece, and a receiving concave part, and wherein the bottom part is engaged by one-touch operation of inserting the tongue-shaped piece into the opposing concave part and disengaged by one-touch operation of pressing the portion of diagonal fold line of head region toward the inside of the container storage box.

12. The storage system according to claim 9, wherein both the top and bottom end faces comprise a closing mechanism.

13. The storage system according to claim 9, wherein two or more sidewall faces of the plurality of rigid sidewall faces are inclined so as to diminish toward the end face of the side comprising the closing mechanism.

14. The storage system according to claim 1, wherein the rigid sidewall face is cardboard having flutes running in lateral direction.

15. The storage system according to claim 1, wherein the material of the rigid sidewall face is a G flute.

16. The storage system according to claim 1, wherein the container storage box is configured to be stored vertically with the end face of large dimension facing down.

17. The storage system according to claim 1, wherein the container storage box is a collecting box of used toner cartridge.

18. The storage system according to claim 1, wherein the image developer comprises toner.

19. The storage system according to claim 1, wherein the image developer comprises developer.

* * * * *